US006340060B1

(12) United States Patent
Larsson et al.

(10) Patent No.: US 6,340,060 B1
(45) Date of Patent: Jan. 22, 2002

(54) METHOD AND EQUIPMENT FOR USE IN RESCUE SERVICE

(75) Inventors: Lars G. Larsson, Särö ; Arne Larsson, Göteborg, both of (SE)

(73) Assignee: Cold Cut Systems Svenska A.B., Kungsbacka (SE)

( * ) Notice: Subject to any disclaimer, the term of this patent is extended or adjusted under 35 U.S.C. 154(b) by 0 days.

(21) Appl. No.: 09/485,122

(22) PCT Filed: Jun. 24, 1998

(86) PCT No.: PCT/SE98/01227

§ 371 Date: Feb. 22, 2000

§ 102(e) Date: Feb. 22, 2000

(87) PCT Pub. No.: WO99/08753

PCT Pub. Date: Feb. 25, 1999

(30) Foreign Application Priority Data

Aug. 15, 1997 (SE) ..... 9702964

(51) Int. Cl.[7] ..... A62C 2/00

(52) U.S. Cl. ..... 169/43; 169/24; 169/54; 169/70; 239/9; 239/165; 239/271; 239/310

(58) Field of Search ..... 239/271, 589, 239/596, 159, 164, 165, 166, 418, 419, 67, 172, 175, 303, 310, 9; 169/24, 25, 43, 52, 54, 70, 91; 451/40, 102

(56) References Cited

U.S. PATENT DOCUMENTS 2,813,753 A * 11/1957 Roberts ..... 239/271
3,762,645 A * 10/1973 Gendron ..... 239/271
4,271,909 A * 6/1981 Chatfield, Jr. et al. ..... 169/70
4,697,740 A 10/1987 Ivy
4,802,535 A * 2/1989 Bakke ..... 169/70
5,301,756 A * 4/1994 Relyea et al. ..... 169/24
5,577,561 A * 11/1996 Cook ..... 169/70
5,913,367 A * 6/1999 Hampton ..... 169/70

FOREIGN PATENT DOCUMENTS

GB 2019213 A 11/1979
GB 2150432 A 7/1985
GB 2198638 A 6/1988
GB 2257357 A 1/1993

* cited by examiner

*Primary Examiner*—Steven J. Ganey
(74) *Attorney, Agent, or Firm*—Burns, Doane, Swecker & Mathis, L.L.P.

(57) ABSTRACT

In accordance with a method for making at least one hole in roofs (1), walls, etcetera, in case of fire (2) in buildings or the like the hole or holes are produced by cutting, using a pressurised liquid (3) which while cutting is sprayed into the space (4) on fire in the shape of a jet (5) which rapidly evaporates and in doing so contributes to extinguishing the fire (2), the combustion gases (6) being vented through the cut hole or holes (25). In equipment (7) designed for the implementation of the method there is provided a source of pressurised medium (8) having an outlet for a pressurised liquid (3), a conduit (10), and a nozzle (11) having an inlet (12) and outlet (13). The conduit is connected at one of its ends to the outlet of the source of pressurised medium (8) and at its opposite end to the inlet (12) of the nozzle (11) for supply of pressurised fluid from the source of pressurised medium to the outlet (13) of the nozzle (11), from which the liquid (3) in the form of a jet (5) is caused to be discharged and to be directed towards the roof (1), the walls, etcetera, in order to cut through said roof, wall, etcetera, to form said number of holes, and in connection with said cut-through to be sprayed into the space (4) on fire in order to assist in extinguishing the fire (2).

18 Claims, 4 Drawing Sheets

METHOD AND EQUIPMENT FOR USE IN RESCUE SERVICE

Figure 1:
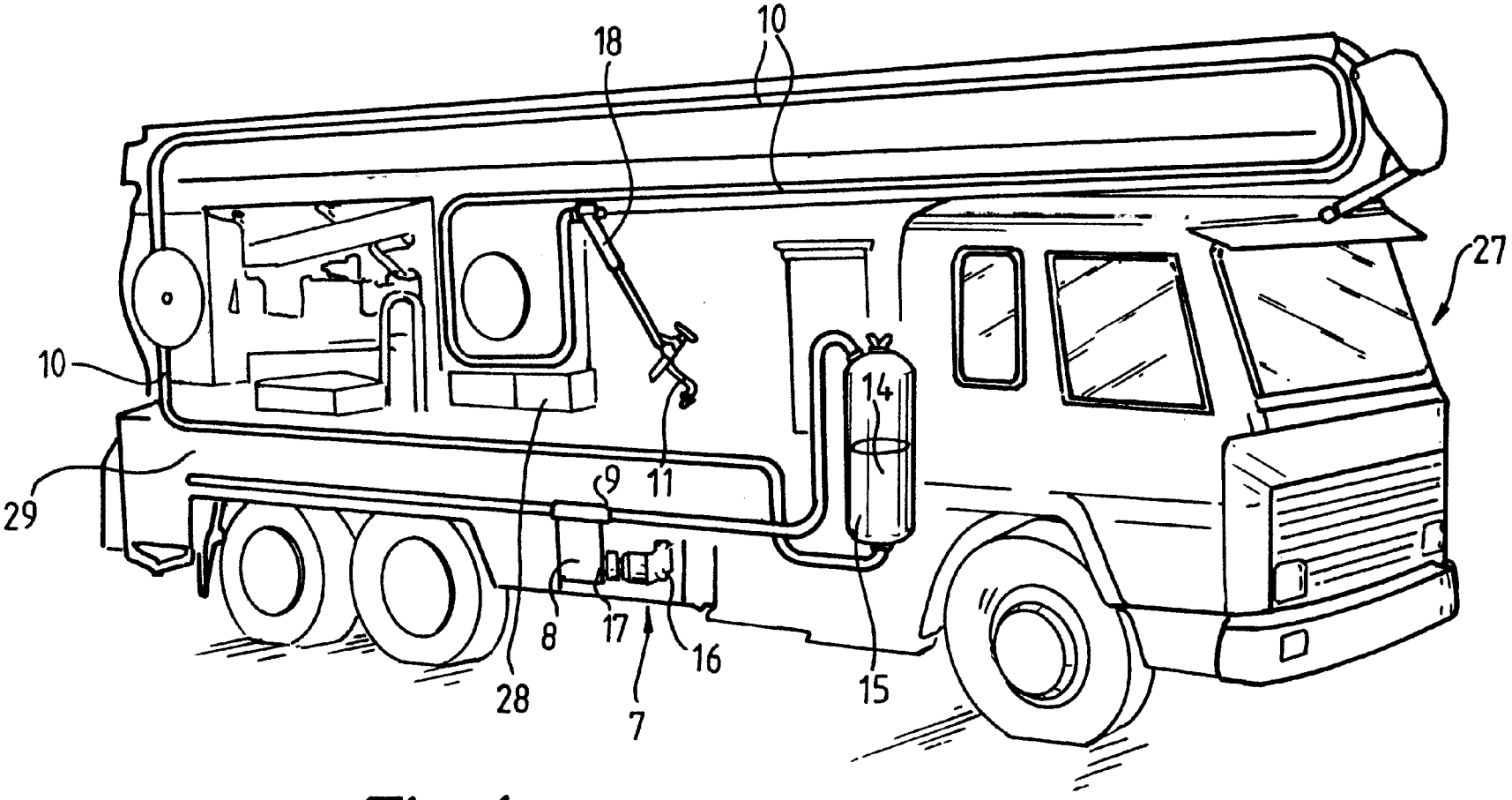

The present invention relates to a method and to equipment for use in rescue service operations generally, for making at least one hole in structures, such as buildings of various kinds, cisterns, tanks and containers designed for various purposes, vehicles, trains and ships, etcetera, in case of accidents or other emergency situations to allow evacuation of gases and liquids and to rescue lives and property, etcetera, and for making holes in roofs, walls, etcetera in fighting fires in structures of the kind outlined above, for the purpose of venting combustion gases and particularly for fire-extinguishing purposes.

Briefly speaking, combustion-gas venting involves controlling, in the case of fires, the extension and development of the fire by affecting the gases that generate during the fire. In practical terms this means cooling the combustion gases and discharging them into the ambient atmosphere via holes that are being made for that purpose, or via hatches, windows, lanterns, sky-lights and the like. The purpose of combustion-gas venting is, primarily, to allow safe evacuation of humans and livestock and to improve the possibilities of saving lives and property, to offer the rescue personnel increased extinguishing and penetration possibilities and to contain the fire and reduce excess pressures and temperatures, and so on.

Hole-making for fire venting and fire fighting purposes is at present effected essentially by means of such hand-held implements as axes, crowbars and break-up iron bars, angular grinding and/or cutting machines, etcetera. More recent equipment and methods use explosive frames, whereby holes are made with the aid of explosions. Explosive frames for this purpose are, however, comparatively expensive and contain explosives, with ensuing strict requirements on above all storage and handling conditions.

Irrespective of whether hand-operated implements and/or explosive frames or the like are used, working with this kind of equipment is very dangerous, both because the rescue personnel need to walk on for instance large flat or more or less steeply inclined roofs on the building on fire in order to make the holes, and because the very handling of the implements and the explosive frames is hazardous, involving risks that the individuals be thrown or clamped. and, when explosive frames are used, risks of premature detonation.

The main object of the present invention is to eliminate as far as possible the above referred-to hazards and disadvantages and to suggest a novel, efficient and safe method and equipment for use in rescue service operations for making holes in structures of the kind outlined in the introduction hereto.

With respect to the method, this main object is achieved in that the hole or holes are produced by means of cutting, using a pressurized liquid which while cutting is sprayed into the structure in question in the shape of a jet for allowing evacuation of gases and liquids and saving of lives and property.

With respect to the equipment, this main object is achieved by the provision of a source of pressurized medium having an outlet for a pressurised liquid, of a conduit, and of a nozzle having an inlet and an outlet, said conduit being connected at one of its ends to the outlet of the source of pressurised medium and at its opposite end to the inlet of the nozzle for supply of pressurised fluid from the source of pressurised medium to the outlet of the nozzle, from which the liquid in the form of a jet is caused to be discharged and to be directed towards the structure in question, in order to cut through said structure to form said number of holes, and in connection with said cut-through to be sprayed into the structure in the form of a jet to evacuate gases and liquid and to rescue lives and property.

A further object of the method is to suggest a method and equipment as defined above for making at least one hole in the roof, walls, etcetera for fighting fires in structures of the kind outlined in the afore-going for venting combustion gases and to extinguish fires.

With respect to the method, this further object is achieved in that the hole or holes are produced by means of cutting, using a pressurised liquid which while cutting is sprayed into the space on fire in the shape of a jet which rapidly evaporates and in doing so contributes to extinguishing the fire, the combustion gases being vented through the cut hole or holes.

The equipment for achieving this further object includes a source of pressurised medium having an outlet for a pressurised liquid, a conduit, and a nozzle having an inlet and outlet, said conduit being connected at one of its ends to the outlet of the source of pressurised medium and at its opposite end to the inlet of the nozzle, for supply of pressurised fluid from the source of pressurised medium to the outlet of the nozzle, from which the liquid in the form of a jet is caused to be discharged and to be directed towards the roof, the wall, etcetera, in order to cut through said roof, wall, etcetera to form said at least one hole, and in connection with said cut-through to be sprayed into the structure in question on fire in order to assist in extinguishing the fire.

In accordance with the teachings of the invention a very rapid, efficient and above all safe method and equipment are provided for use in rescue service operations for making holes in structures of the kind defined in the introduction, particularly for making holes in structures on fire of the kind defined above.

Experiments show that conventionally structured roof comprising e.g. external roofing sheets, insulation and internal roofing sheets having a total thickness of 20–30 cm was cut through in only a few seconds, and in the case of the most difficult experiment, the cutting speed amounted to 1 m/min. The considerable safety offered by the method and the equipment is related to the fact that contrary to the case when cutting tools, explosive frames and similar equipment are used, the inventive method and equipment do not in themselves generate heat and/or sparks.

Figure 2:
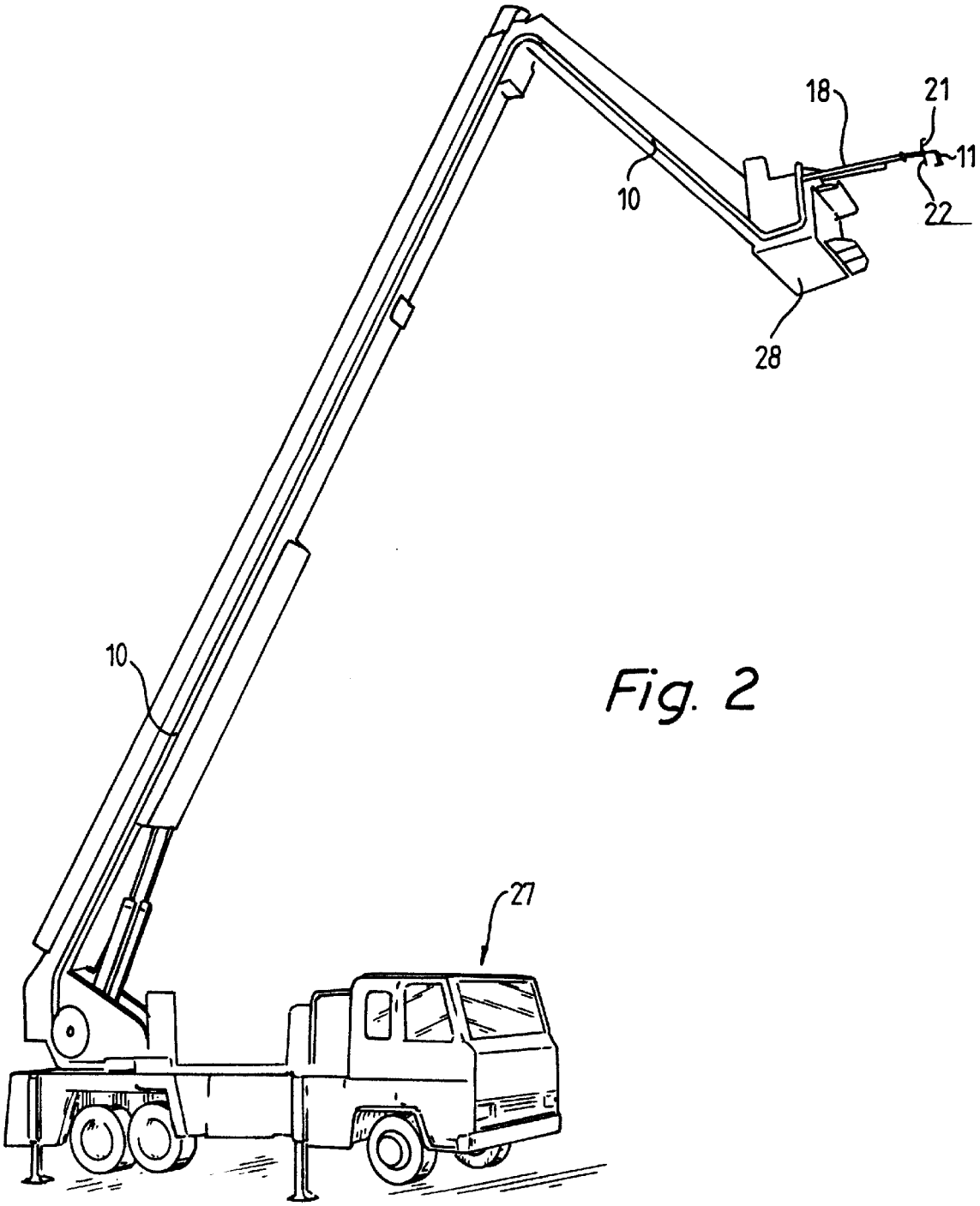
Figure 3:
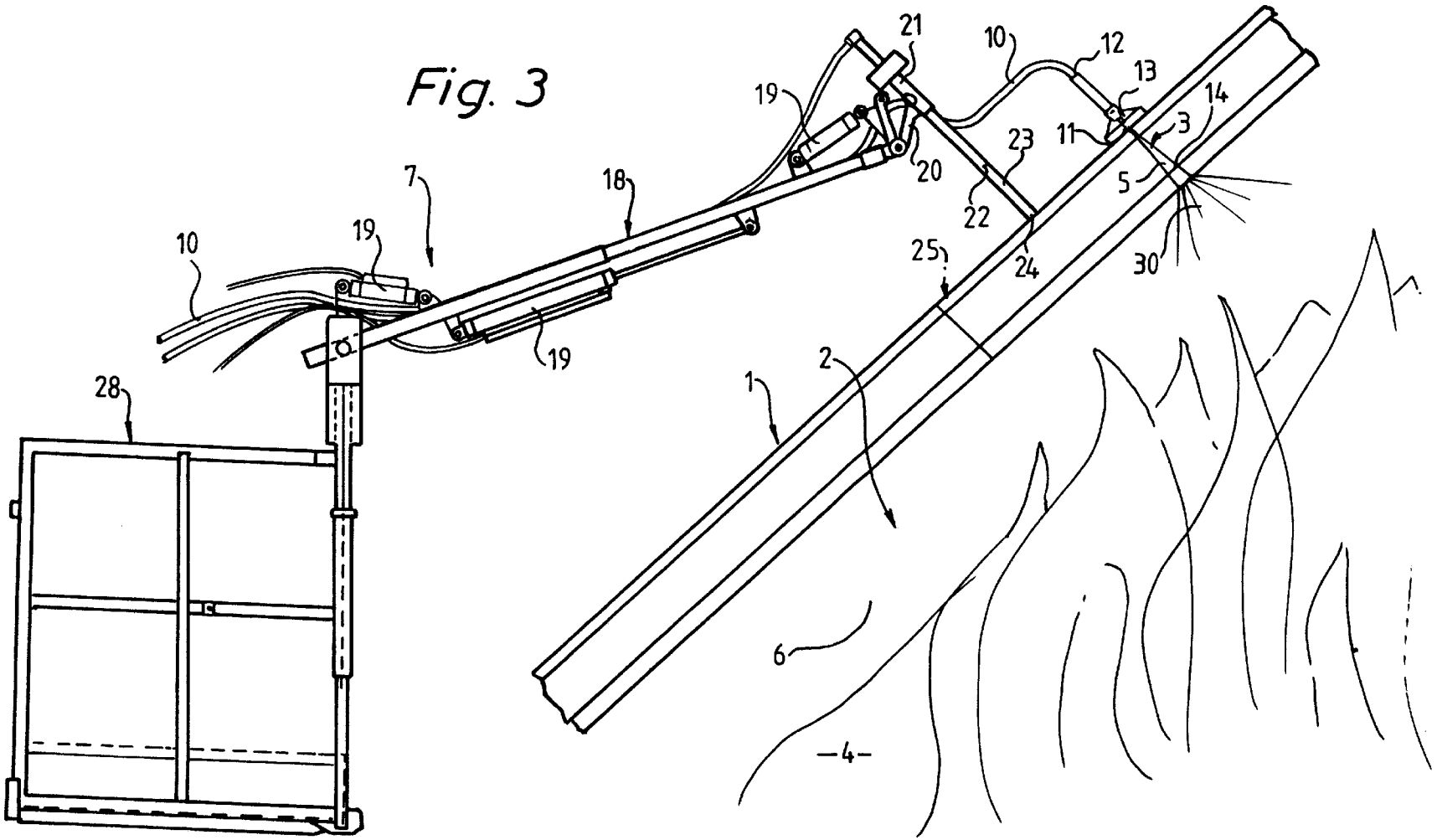
Figure 4:
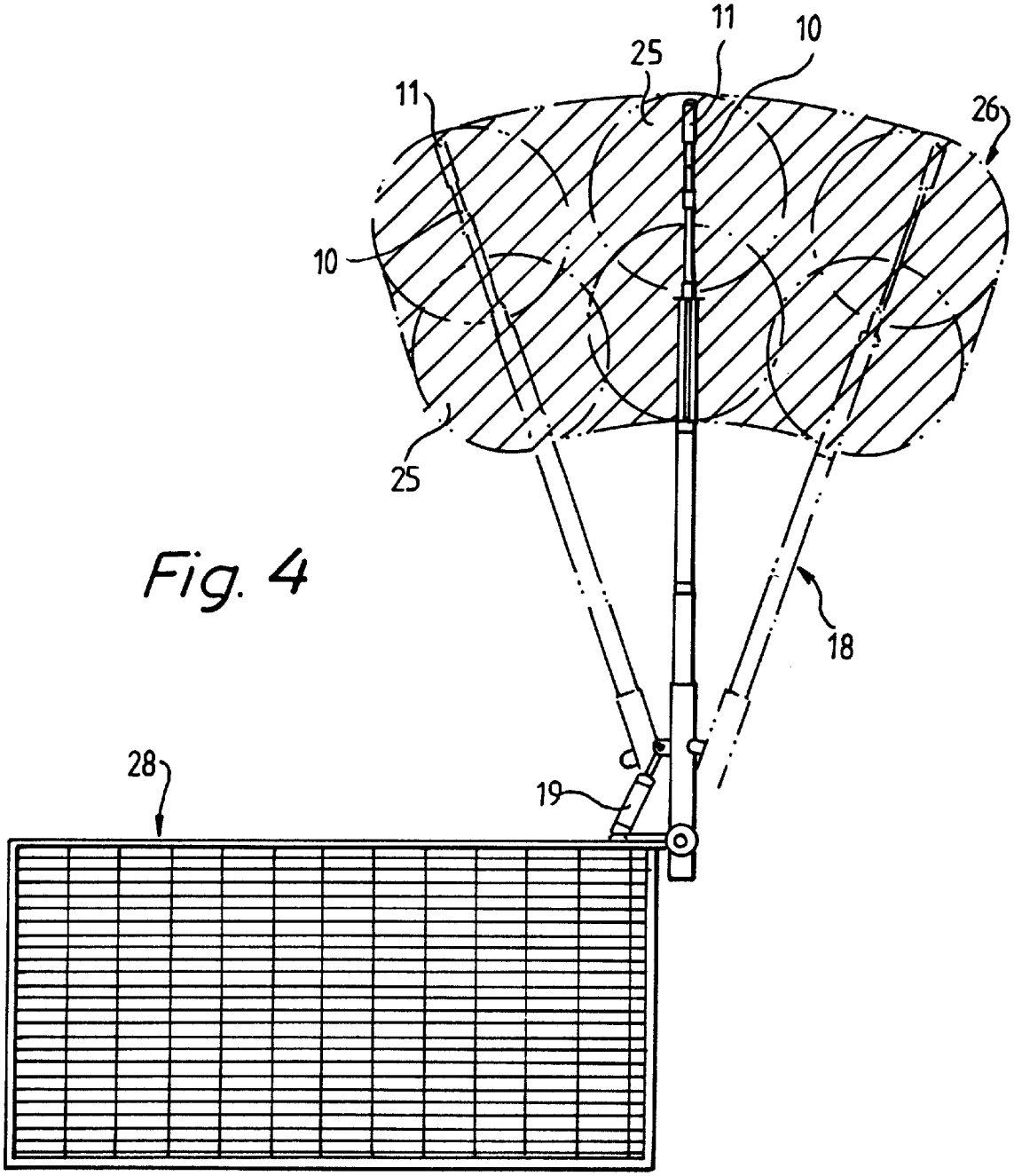

The invention will be described in closer detail in the following with reference to the accompanying drawings wherein is illustrated an at presently particularly preferred embodiment among several possible ones. In the drawings:

FIG. 1 is a schematic perspective view as seen obliquely from the front, of a fire-brigade vehicle in position of transport, in the subject case a vehicle including elevating equipment in the form of an hydraulic platform on which the equipment in accordance with the invention is mounted, FIG. 2 is a similar perspective view of the same vehicle as in FIG. 1 but showing the vehicle and the equipment in one of several possible fire-fighting positions, FIG. 3 is a lateral view of the upper part of the vehicle which supports an operator's cage, parts of the equipment in accordance with the invention assuming the roof hole-making position, and FIG. 4 is a view from above of the operator's cage and the equipment of FIG. 3.

In accordance with the inventive method for making holes in a roof 1, see FIG. 4, walls, doors, etcetera of a building or the like, not shown in more detail, in the case of a fire 2, for the purpose of allowing venting of combustion gases and fire extinction, the hole is produced by cutting, using a pressurised liquid 3 which while cutting is sprayed into a space 4 on fire in the building, etctera on fire in the shape of a jet 5 which rapidly evaporates and in doing so contributes to extinguishing the fire 2, the combustion gases 6 being vented through the cut hole.

Normally, the liquid is ordinary water but as a rule one or several liquids and/or particulate additives are added thereto in order to enhance the hole-making and/or extinguishing properties. One such additive is an abrasive 14, such as a blasting medium which contains sand or other abrasive substances that increase the cutting speed for penetration of the roof 1, etcetera. Another additive may be a foaming agent or the like which, when the liquid 3 is being sprayed into the burning space 4, generates foam for the purpose of jointly with the vapour that forms simultaneously, rapidly lowering the temperature in the fire 2, thus further contributing to efficient fire-extinction. Prior to being vapourised, the jet 5 of liquid is converted into a mist 30 of finely divided liquid in order to additionally contribute to efficient fire-extinction.

The equipment generally designated in the drawing figures by numeral reference 7 for application of the above method comprises the following main components, viz. a source 8 of pressurized medium having an outlet 9 for the pressurised liquid 3, a conduit 10, and a nozzle 11 having an inlet 12 and and outlet 13. The conduit 10 is connected at one of its ends to the outlet 9 of the source 8 of pressurised medium and at its opposite end to the inlet 12 of the nozzle 11 for supply of the pressurised fluid from the source 8 of pressurised medium to the outlet 13 of the nozzle 11. The pressurised liquid 3 in the form of the above-mentioned jet 5 is caused to be discharged and be directed towards the roof 1, the wall, etcetera, so as to cut through said roof, wall, etcetera, thus forming a hole, and in connection with said cut-through to be sprayed into the space 4 on fire in order thus to assist in extinguishing the fire 2.

The above-described equipment 7 likewise comprises a vessel 15 containing the above defined abrasive 14. The vessel 15 is connected to the conduit 10 at a point intermediate the source 8 of pressurised medium and the nozzle 11 for adjustable addition of the abrasive 14 to the liquid 3 in order to enhance the hole-making and cutting efficiency as mentioned above.

In the shown and preferred embodiment described above, the source 8 of pressurised medium preferably is formed by a high-pressure pump 17 which is driven by a motor 16. As is the case in the shown embodiment, the motor may be a hydraulic motor, in turn being driven by a pump or an engine, not shown, for instance an internal combustion engine. The motor 16 as well as the high-pressure pump 17 are of a more or less conventional design. The capacity of the high-pressure pump 17 is such that the pump may deliver pressurised liquid 3 at a pressure in the order of 100–300 bar, preferably about 200 bar, and at a flow rate in the order of 20–60 l/min, preferably about 40 l/min. In some applications the pressure may exceed the values above and amount to say 400 bars or more, and also the flow rate may exceed that mentioned above and amount to say 100 l/min or more.

The nozzle 11 forming part of the equipment 7 is supported at the outer free end of an arm 18. This arm is mounted for movement in all directions when actuated by an actuation means 19 preferably an hydraulic piston-and-cylinder unit. A bracket 20 is connected to the arm 18 at the outer free end thereof and supports a power-operated rotator 21, which preferably is driven by hydraulic means. On the rotator is mounted an essentially circular cylindrical holder 23 which is rotatable about a centre axis 22 and which is formed at its end remote from the rotator 21 with a support 24 positioned in the centre axis 22. Preferably, the support is configured as a more or less pointed stud designed for supporting abutment against the roof 1, wall, etcetera.

The nozzle 11 is connected to the holder 23 and is positioned essentially in parallel with the centre axis 22 in spaced relationship thereto such that said nozzle 11, upon rotation of the holder by means of the rotator 21, is caused to orbit the centre axis and in doing so cut an essentially circular hole 25 in the roof 1, wall, etcetera.

By pivoting the movable arm 18 by means of the actuating means 19, see FIG. 4, at least one hole 25 may be made adjacent one another and so as to partly overlap, see FIG. 4, thus allowing a larger hole 26 (the hatched area in FIG. 4) to be produced for additionally efficient combustion-gas venting and fire extinction.

Depending on the size and mass of the components incorporated in the equipment described so far, the entire equipment or parts thereof may be carried by hand/hand-held. It is, however, preferred to install the entire equipment on a vehicle 27, preferably a fire-brigade motor vehicle, a trailer hauled by such a vehicle or, most preferable, on such an elevating mechanism as the hydraulic platform illustrated in the drawing figures. The mechanism is equipped with an operator's cage 28 and at its end remote from the nozzle 11 the arm 18 is movably connected to the operator's cage. In this case the conduit 10 extends between the operator's cage 28 and the chassis 29 of the fire-brigade vehicle 27 or the like on which the motor 16, the high-pressure pump 17, and the vessel 15 containing the abrasive 14 are mounted together with ancillary operating equipment and accessories.

To obviate the need for the rescue personnel to walk on the roof 1, etcetera of the building on fire, and to thus further enhance safety, the equipment, at least the arm 18 and the nozzle 11, are telecontrolled via the actuating means 19 and/or the rotator 21 from the operator's cage 28 and/or from some other place spaced from the area immediately adjacent the hole-making area.

It is to be understood that the invention should not be regarded as restricted to the embodiment as described and illustrated but that it could be modified optionally in many ways within the scope of the protection as defined in the appended claims.

What is claimed is:

1. A rescue service method for making at least one hole in a structure having a space in which there is a fire for combustion-gas venting and fire extinction, comprising:

cutting at least one hole using a pressurized liquid sprayed from a nozzle, the liquid, while cutting, is sprayed into the space in which there is a fire in the shape of a jet which evaporates and, in doing so, contributes to extinguishing the fire;

supporting, with a support arranged to abut against the structure, a holder connected to the nozzle, rotating the holder about a center axis of the holder, the holder and being positioned in parallel with the center axis in spaced relationship thereto such that the nozzle, upon rotation of the holder, is caused to orbit the center axis and in doing so cut an essentially circular hole in the structure; and venting the combustion gases through the at least one cut hole.

2. A method as claimed in claim 1, wherein, prior to evaporation, the liquid jet is transformed into a mist of atomized liquid (30).

3. A method as claimed in claim 2, wherein the liquid includes an abrasive, a pressure of the liquid is set at 100–300 bar and a flow rate of the liquid is set at 20–60 1/min.

4. A method as claimed in claim 1, wherein the liquid includes an abrasive, a pressure of the liquid is set at 100–300 bar and a flow rate of the liquid is set at 20–60 1/min.

5. Equipment for rescue service operations for making at least one hole in structures having a space in which there is a fire for combustion-gas venting and fire extinction, comprising:

a source of pressurized liquid;

a conduit connected to the source of pressurized liquid; and a nozzle having an inlet and outlet, the conduit being connected at one of its ends to an outlet of the source of pressurized liquid and at an opposite end to the inlet of the nozzle for supply of liquid from the source pressurized liquid to the outlet of the nozzle, the source of pressurized liquid, the conduit, and the nozzle cooperating to cause liquid to exit the outlet of the nozzle as a jet adapted to cut at least one hole in the structure to the space and also to be sprayed into the space in such a manner as to assist in extinguishing the fire in the space, wherein the nozzle is disposed at an outer free end of an arm which is movable in all directions, and wherein the equipment includes an actuator permitting movement of the arm in all directions and a bracket connected to the arm at the outer free end thereof so as to support a power-operated rotator on which a holder is mounted for rotation about a center axis, the holder including, at an end remote from the rotator, a support arranged to abut against the structure, the nozzle being connected to the holder and being positioned in parallel with the center axis in spaced relationship thereto such that the nozzle, upon rotation of the holder, is caused to orbit the center axis and in doing so cut an essentially circular hole in the structure.

6. Equipment as claimed in claim 5, wherein at least one vessel containing an abrasive is connected to the conduit at a point intermediate the source of pressurized liquid and the nozzle so that the abrasive is adapted to be added to the liquid to reinforce the cutting efficiency.

7. Equipment as claimed in claim 6, wherein the source of pressurized liquid includes at least one high-pressure pump for delivering the liquid at a pressure of 100–300 bar and at a flow rate of 20–60 1/mm.

8. Equipment as claimed in claim 7, wherein the nozzle is disposed at an outer free end of an arm which is movable in all directions.

9. Equipment as claimed in claim 6, wherein the nozzle is disposed at an outer free end of an arm which is movable in all directions.

10. Equipment as claimed in claim 5, wherein the source of pressurized liquid includes at least one high-pressure pump for delivering the liquid at a pressure of 100–300 bar and at a flow rate of 20–60 1/min.

11. Equipment as claimed in claim 10, wherein the nozzle is disposed at an outer free end of an arm which is movable in all directions.

12. Equipment as claimed in claim 5, wherein at least the arm and the nozzle are telecontrolled via at least one of the actuator and the rotator from an area remote from an area of the structure in which the at least one hole is cut.

13. Equipment for rescue service operations for making at least one hole in structures having a space in which there is a fire for combustion-gas venting and fire extinction, comprising:

a source of pressurized liquid;

a conduit connected to the source of pressurized liquid; and a nozzle having an inlet and outlet, the conduit being connected at one of its ends to an outlet of the source of pressurized liquid and at an opposite end to the inlet of the nozzle for supply of liquid from the source pressurized liquid to the outlet of the nozzle, the source of pressurized liquid, the conduit, and the nozzle cooperating to cause liquid to exit the outlet of the nozzle as a jet adapted to cut at least one hole in the structure to the space and also to be sprayed into the space in such a manner as to assist in extinguishing the fire in the space, wherein the equipment is adapted to be installed in a fire-brigade motor vehicle, the conduit being adapted to extend between an operator's cage and a chassis of the fire-brigade vehicle, the source pressurized liquid being adapted to be mounted on the chassis of the fire-brigade vehicle.

14. Equipment for rescue service operations for making at least one hole in structures having a space in which there is a fire for combustion-gas venting and fire extinction, comprising:

a source of pressurized liquid;

a conduit connected to the source of pressurized liquid; and a nozzle having an inlet and outlet, the conduit being connected at one of its ends to an outlet of the source of pressurized liquid and at an opposite end to the inlet of the nozzle for supply of liquid from the source pressurized liquid to the outlet of the nozzle, the source of pressurized liquid, the conduit, and the nozzle cooperating to cause liquid to exit the outlet of the nozzle as a jet adapted to cut at least one hole in the structure to the space and also to be sprayed into the space in such a manner as to assist in extinguishing the fire in the space, wherein at least one vessel containing an abrasive is connected to the conduit at a point intermediate the source of pressurized liquid and the nozzle so that the abrasive is adapted to be added to the liquid to reinforce the cutting efficiency, and wherein the equipment is adapted to be installed in a fire-brigade motor vehicle, the conduit being adapted to extend between an operator's cage and a chassis of the fire-brigade vehicle, the source pressurized liquid being adapted to be mounted on the chassis of the fire-brigade vehicle.

15. Equipment for rescue service operations for making at least one hole in structures having a space in which there is a fire for combustion-gas venting and fire extinction, comprising:

a source of pressurized liquid;

a conduit connected to the source of pressurized liquid; and a nozzle having an inlet and outlet, the conduit being connected at one of its ends to an outlet of the source of pressurized liquid and at an opposite end to the inlet of the nozzle for supply of liquid from the source pressurized liquid to the outlet of the nozzle, the source of pressurized liquid, the conduit, and the nozzle cooperating to cause liquid to exit the outlet of the nozzle as a jet adapted to cut at least one hole in the structure to the space and also to be sprayed into the space in such a manner as to assist in extinguishing the fire in the space, wherein the source of pressurized liquid includes at least one high-pressure pump for delivering the liquid at a pressure of 100–300 bar and at a flow rate of 20–60 1/min, and wherein the equipment is adapted to be installed in a fire-brigade motor vehicle, the conduit being adapted to extend between an operator's cage and a chassis of the fire-brigade vehicle, the source pressurized liquid being adapted to be mounted on the chassis of the fire-brigade vehicle.

16. Equipment for rescue service operations for making at least one hole in structures having a space in which there is a fire for combustion-gas venting and fire extinction, comprising:

a source of pressurized liquid;

a conduit connected to the source of pressurized liquid; and a nozzle having an inlet and outlet, the conduit being connected at one of its ends to an outlet of the source of pressurized liquid and at an opposite end to the inlet of the nozzle for supply of liquid from the source pressurized liquid to the outlet of the nozzle, the source of pressurized liquid, the conduit, and the nozzle cooperating to cause liquid to exit the outlet of the nozzle as a jet adapted to cut at least one hole in the structure to the space and also to be sprayed into the space in such a manner as to assist in extinguishing the fire in the space, wherein the nozzle is disposed at an outer free end of an arm which is movable in all directions, and wherein the equipment is adapted to be installed in a fire-brigade motor vehicle, the conduit being adapted to extend between an operator's cage and a chassis of the fire-brigade vehicle, the source pressurized liquid being adapted to be mounted on the chassis of the fire-brigade vehicle.

17. Equipment for rescue service operations for making at least one hole in structures having a space in which there is a fire for combustion-gas venting and fire extinction, comprising:

a source of pressurized liquid;

a conduit connected to the source of pressurized liquid; and a nozzle having an inlet and outlet, the conduit being connected at one of its ends to an outlet of the source of pressurized liquid and at an opposite end to the inlet of the nozzle for supply of liquid from the source pressurized liquid to the outlet of the nozzle, the source of pressurized liquid, the conduit, and the nozzle cooperating to cause liquid to exit the outlet of the nozzle as a jet adapted to cut at least one hole in the structure to the space and also to be sprayed into the space in such a manner as to assist in extinguishing the fire in the space, wherein at least one vessel containing an abrasive is connected to the conduit at a point intermediate the source of pressurized liquid and the nozzle so that the abrasive is adapted to be added to the liquid to reinforce the cutting efficiency, and wherein at least the nozzle is telecontrolled via an actuator from an area remote from an area of the structure in which the at least one hole is cut.

18. Equipment for rescue service operations for making at least one hole in structures having a space in which there is a fire for combustion-gas venting and fire extinction, comprising:

a source of pressurized liquid;

a conduit connected to the source of pressurized liquid; and a nozzle having an inlet and outlet, the conduit being connected at one of its ends to an outlet of the source of pressurized liquid and at an opposite end to the inlet of the nozzle for supply of liquid from the source pressurized liquid to the outlet of the nozzle, the source of pressurized liquid, the conduit, and the nozzle cooperating to cause liquid to exit the outlet of the nozzle as a jet adapted to cut at least one hole in the structure to the space and also to be sprayed into the space in such a manner as to assist in extinguishing the fire in the space, wherein at least the nozzle is telecontrolled via an actuator from an area remote from an area of the structure in which the at least one hole is cut.

* * * * *